United States Patent [19]

Roth

[11] 4,119,104

[45] Oct. 10, 1978

[54] TOBACCO SUBSTITUTE HAVING IMPROVED ASH CHARACTERISTICS

[75] Inventor: David S. Roth, Louisville, Ky.

[73] Assignee: Brown & Williamson Tobacco Corporation, Louisville, Ky.

[21] Appl. No.: 797,642

[22] Filed: May 17, 1977

Related U.S. Application Data

[63] Continuation of Ser. No. 631,094, Nov. 11, 1975, abandoned.

[51] Int. Cl.[2] ..... A24D 1/18; A24B 3/14

[52] U.S. Cl. ..... 131/2; 131/17 AC

[58] Field of Search ..... 131/2, 17, 140 R, 140 C, 131/15 R, 15 C, 8 R, 8 A, 9

[56] References Cited

U.S. PATENT DOCUMENTS

| | | | |
|---|---|---|---|
| 1,879,128 | 9/1932 | Desper | 131/15 |
| 2,329,927 | 4/1938 | Morton | 131/17 R X |
| 2,707,472 | 5/1955 | Jurgensen | 131/17 A |
| 2,809,904 | 10/1957 | Koree | 131/2 |
| 3,100,492 | 8/1967 | Schmidt | 131/2 |
| 3,410,276 | 11/1968 | Armbrust et al. | 131/9 |
| 3,459,195 | 8/1969 | Silberman et al. | 131/2 |
| 3,461,879 | 8/1969 | Kirkland | 131/2 |
| 3,464,422 | 9/1969 | Light et al. | 131/17 A |
| 3,477,865 | 11/1969 | Armbrust et al. | 131/2 UX |
| 3,528,432 | 9/1970 | Stossec | 131/4 |
| 3,545,448 | 12/1976 | Mormon | 131/2 |
| 3,638,660 | 1/1972 | Davis | 131/2 |
| 3,782,392 | 1/1974 | Monte | 131/2 |
| 3,812,864 | 5/1974 | Cartwright | 131/2 |

FOREIGN PATENT DOCUMENTS

| | | | |
|---|---|---|---|
| 175,148 | 6/1953 | Austria | 131/15 R |
| 1,157,574 | 7/1969 | United Kingdom | 131/2 |

*Primary Examiner*—Robert W. Michell
*Assistant Examiner*—V. Millin
*Attorney, Agent, or Firm*—William J. Mason; Charles G. Lamb

[57] ABSTRACT

Tobacco substitutes which eliminate excessive blooming of cigarette ash are disclosed. The tobacco substitutes comprise an organic binder; an inorganic filler; a boric oxide, boron oxyacid, or boron oxyacid salt; ash stabilizer; and, as a bloom control agent, from about 10% to about 40% by weight of tobacco fines. The substitute may also include up to about 10% by weight of a burning rate accelerator, such as sodium nitrate, sodium citrate or potassium tartrate.

31 Claims, 2 Drawing Figures

TOBACCO SUBSTITUTE HAVING IMPROVED ASH CHARACTERISTICS

This is a continuation of application Ser. No. 631,094, filed Nov. 11, 1975, now abandoned.

FIELD OF INVENTION

The present invention relates to a tobacco substitute material. More specifically, the present invention pertains to a tobacco substitute which, which blended with cut tobacco in a cigarette, produces an ash which resembles the ash from a cigarette containing all tobacco. The subject tobacco substitute comprises an organic binder and boric oxide, a boron oxyacid, or a boron oxyacid salt. The tobacco substitute also contains from about 10% to about 40% by weight of tabacco fines and an inorganic filler such as alumina trihydrate, $CaCO_3$, $MgCO_3$ and charcoal.

BACKGROUND OF THE INVENTION

Tobacco substitute or synthetic smoking materials have been known for some time. Such materials, which may be included in smoking articles as the sole smokeable material or in admixture with natural tobacco, may be employed for economic reasons, or to affect the composition of the smoke resulting from a smokeable article.

Numerous tobacco substitutes are known; typical tobacco substitutes are described in, e.g., U.S. Pat. Nos. 2,809,904; 3,410,276; 3,461,879; 3,477,865; and 3,732,392. Generally, such tobacco substitutes comprise a binder, a fibrous filler, such as asbestos or kraft pulp, to impart strength to the tobacco substitute sheet and a combustion control or burning rate modifying agent. In some instances, substitutes may also require an ash control agent.

Another tobacco substitute is disclosed in copending U.S. application Ser. No. 527,175, filed on Nov. 25, 1974 by David G. Strubel and Robert R. Johnson, and entitled "Tabacco Substitute Containing Boric Oxide, Boric Oxyacids, and Ammonium, Alkali Metal, or Alkaline Earth Metal Salts of Boron Oxyacids."

Tobacco substitutes desirably have a number of properties which are analogous to those of natural tobacco. For example, tobacco substitutes should have burning characteristics which are compatible with natural tobacco. However, some otherwise suitable tobacco substitute compositions burn too rapidly or at too high a temperature to be suitable for use as smokeable items. In order to overcome this disadvantage, constituents such as hydrated alumina have been incorporated into the reconstituted tobacco as combustion control or burning rate control agents.

Another problem with many tobacco substitute compositions is that they tend to "bloom" upon combustion. Blooming occurs when the ash expands, becomes incoherent and disintegrates. Often in cigarettes containing blends of tobacco and tobacco substitutes, rather than forming a natural-appearing coherent ash, the filament or ribbon-like ashes of the tobacco and tobacco substitute particles separate and peel out from the center of the ash causing blooming. The expanded ash has a very unattractive appearance and is weakened to the degree that large hot particles flake off. Another characteristic of such an ash is its tendency to fall off prematurely with little or no agitation of the cigarette.

Various materials are known to affect ashing properties, and in some instances, fibrous materials have served both to support the ash after combustion and to impart strength to the substitute sheet. Fibrous materials used to support tobacco substitute ash include asbestos or cellulosic materials, such as cellulose gauze treated with a flameproofing agent.

The present invention pertains to tobacco substitutes produced in the form of coherent sheets which can be subsequently shredded into a form suitable for use in smokeable products. The product of the present invention, in admixture with tobacco, has a burn rate which is suitable for use in a smokeable product. In addition, the compositions of the present invention, upon combustion, form a stable, normal-appearing, non-blooming ash. Furthermore, the tobacco substitutes of the present invention do not impart undesirable taste to smokeable products, and may be economically produced.

SUMMARY OF THE INVENTION

The present invention pertains to tobacco substitutes comprising an organic binder; an ash stabilizer comprising boric oxide, boron oxyacids, or ammonium, alkali metal or alkaline earth metal salts of boron oxyacids; a bloom control agent comprising from about 10% to about 40% by weight of tobacco fines; and an inorganic filler. These tobacco substitutes may be employed in admixture with natural tobacco in amounts up to about 50% by weight, preferably about 3% to about 50% by weight.

The tobacco substitutes of the present invention comprise from about 2% to about 35% by weight of boric oxide, a boron oxyacid, or an ammonium, alkali metal, or alkaline earth metal salt of a boron oxyacid; from about 5% to about 35% by weight of an organic binder; from about 10% to about 40% by weight to tobacco fines, such as manufacturing fines, ground flue-cured stem, ground burley stem or water-extracted stem; and from about 25% to about 75% by weight of an inorganic filler selected from the group consisting of alumina, alumina trihydrate, magnesium carbonate, calcium carbonate and charcoal.

The tobacco substitute of the present invention may optionally include up to about 15% by weight monoammonium phosphate, diammonium phosphate or mixtures thereof. The substitutes may also contain a humectant or plasticizer, to improve flexibility. Other ingredients which may be optionally included in the tobacco substitutes are burning rate accelerators, flavoring and/or coloring agents, and cellulosic fibers, such as paper fibers, to increase the strength of the substitute sheet.

DESCRIPTION OF PREFERRED EMBODIMENTS

Figure 1:
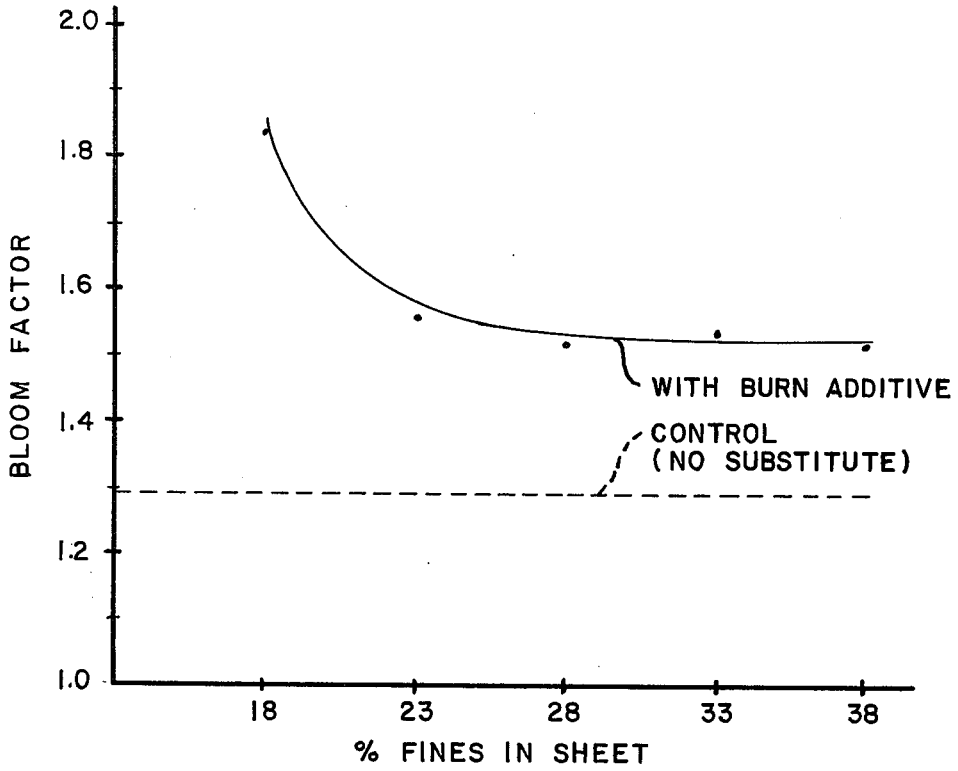
FIG. 1 is a plot of bloom factor vs. amount of tobacco fines in sheets of tobacco substitutes, as measured in cigarettes made from a blend comprising 75% by weight tobacco and 25% by weight tobacco substitute.

The tobacco substitutes of the present invention includes, as a filler, an inorganic material, such as calcium carbonate, magnesium carbonate, charcoal, alumina or alumina trihydrate or mixtures of these materials. The inorganic filler may be included in amounts of from about 25% to about 75% by weight, and preferably in amounts of from about 40% to about 60% by weight.

The preferred filler is alumina trihydrate. These hydrates of alumina, which may be presented by the formulas $Al_2O_3.3H_2O$ or $Al(OH)_3$, are dry, free-flowing white crystalline products available in abundance from the Bayer or Bayer-sinter process. The combined water of these hydrates is releasable upon heating, starting at a temperature of about 150° C.

The particle size of the inorganic filler is not critical; a wide variety of particle sizes may be used with equal efficacy. However, with very small particles, it is preferred to include a wetting agent in the composition which is formed into the tobacco substitutes in order to insure that the particles are distributed throughout the binder and to prevent dusting.

One of the major problems encountered in using inorganic filler (particularly alumina) containing tobacco substitutes in smoking articles is "flaking" and falling of the ash when the smoking article is burning. In the tobacco substitutes of the present invention, this problem is largely overcome by adding boric oxide; a boron oxyacid; an ammonium, alkali metal or alkaline earth metal salt of a boron oxyacid; or a mixture of the foregoing boron compounds, to the substitute. The boron compounds may function as a tobacco substitute filler and/or as a burn and ash control additive. During combustion of a smokeable product containing the tobacco substitute, the boron compound melts or fuses and serves to bind the combustion residue of the inorganic filler, thus tending to insure a stable ash.

A large number of different boron oxyacids or boron oxyacid salts may be employed, as long as they do not produce obnoxious or toxic fumes when subjected to temperatures encountered during smoking. Specific examples of suitable compounds include boric acid ($H_3BO_3$), metaboric acid ($HBO_2$), pyroboric acid ($H_2B_4O_7$), borax ($Na_2B_4O_7.10H_2O$), sodium tetraborate ($Na_2B_4O_7$), sodium tetraborate pentahydrate ($Na_2B_4O_7.5H_2O$), sodium metaborate ($NaBO_2.4H_2O$), potassium metaborate ($KBO_2$), potassium tetraborate ($K_2B_4O_7.5H_2O$), lithium metaborate dihydrate ($LiBO_3.2H_2O$), lithium tetraborate ($Li_2B_4O_7.5H_20$), calcium metaborate [$Ca(BO_2)_2$] and hydrates thereof, calcium tetraborate ($CaB_4O_7$), magnesium orthoborate ($3MgO.B_20_3$), magnesium metaborate [$Mg(BO_2)_2.8H_2O$)], magnesium pyroborate ($Mg_2B_2O_5.H_20$), lithium metaborate ($LiBO_2.8H_2O$), lithium tetraborate ($Li_2B_4O_7.5H_2O$), ammonium tetraborate [$(NH_4)_2B_4O_7.4H_2O$] and ammonium pentaborate [$(NH_4)_2B_{10}O_{16}.8H_2O$]. Mixtures of the boron oxyacids or oxyacid salts may be used.

The tobacco substitutes of the present invention may include from about 2% to about 35% by weight, and preferably from about 3% to about 10% by weight of the boron compound. Borax and boric acid are the preferred additives.

The tobacco substitutes of the present invention include tobacco fines which lend a degree of combustibility to the tobacco substitute and allow a normal-appearing ash to form. Preferred tobacco fines may comprise any one or a mixture of manfucturing fines; dried, ground flue-cured stem; or dried, ground burley stem. The tobacco fines may be added in amounts of from about 10% to about 40% by weight, and preferably from about 10% to about 25% by weight.

Blooming or ash expansion is a serious problem with tobacco substitutes containing non-combustible materials, such as inorganic fillers. It has been found, in accordance with the present invention, that inclusion of tobacco fines in tobacco substitutes containing non-combustible materials eliminates excessive blooming. Tobacco fines, particularly manufacturing fines, are an advantageous tobacco substitute additive, not only from the standpoint of imparting combustibility and reducing blooming, because they are inexpensive, plentiful and impart a desirable light brown color to the substitute sheet.

The tobacco substitutes of the present invention may include a small amount of a burning rate accelerator, or burn additive, preferably sodium nitrate, sodium citrate or potassium tartrate. It has been found that these burn additives not only impart a degree of combustibility to the tobacco substitute, but that they also act to reduce blooming in tobacco substitute formulations containing tobacco fines. While other burning additives, such as sodium hydroxide, potassium citrate, potassium nitrate or calcium peroxide may be employed in small amounts to increase the combustibility of the tobacco substitute, they do not provide the desired elimination of blooming characterized by sodium nitrate, sodium citrate and potassium tartrate.

The burning accelerator, which may be included in amounts up to 10% by weight, by itself is not effective to eliminate excessive blooming. However, if burn additives are included in the tobacco substitute, excessive blooming can be eliminated with the inclusion of smaller amounts of tobacco fines than would otherwise be possible. Larger amounts of tabacco fines, e.g., in excess of about 20% by weight, are effective to eliminate excessive blooming even in the absence of a burn additive. If less than 20% by weight tobacco fines are included in the substitute, inclusion of a burn additive is desirable if maximum comtrol of blooming is to be achieved.

FIG. 1 illustrates the relationship found between fines content of substitute sheet and cigarette blooming (in cigarettes containing 25% by weight substitute with no burn additive and 75% of a commercial cigarette tobacco blend). Cigarette bloom factor, an objective measure of the acceptability of ash appearance, is the ratio of the ash diameter to the unburned cigarette diameter. FIG. 1 shows that an increase in fines content above about 23% does not result in further bloom factor improvement. The Figure also indicates the blooming of a control all-tobacco cigarette and a cigarette containing 25% of substitute comprising 18% fines and 5% sodium nitrate. As is apparent, the burn additive in the substitute containing 18% fines is effective to substantially reduce blooming.

Figure 2:
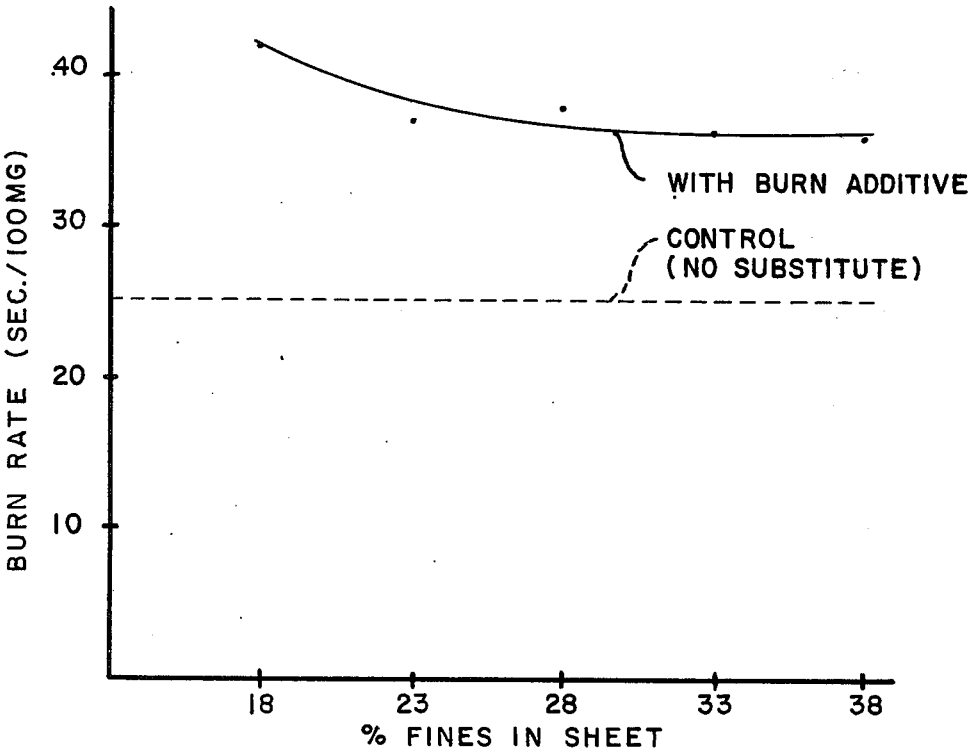
FIG. 2 is a plot of free burn rate vs. amount of tobacco fines in sheets of tobacco substitutes, as measured in cigarettes made from a blend comprising 75% by weight tobacco and 25% by weight tobacco substitutes.

A parallel relationship, illustrated in FIG. 2, exists between manufacturing fines content of substitute and free burn rate (expressed as seconds per 100 mg of cigarette consumed) of cigarettes containing 25% substitute (no burn additive) and 75% of a commercial cigarette tobacco blend. Increasing fines content above about 23% does not appreciably increase free burn rate. Values for a control (commercial) cigarette and a sample containing a substitute comprising 18% fines and 5% sodium nitrate are indicated in the Figure. Note that the burn additive increases burn rate in the substitute containing 18% fines.

The tobacco substitutes of the present invention include an organic binder. A wide variety of natural or synthetic binders are suitable, provided they are not inimical to flavor and do not generate obnoxious or toxic fumes upon combustion. Specific examples of suitable binders include natural vegetable gums such as gum arabic, gum tragacanth, guar gum, locust bean gum, etc. Other suitable gums include carbohydrate gums from animal sources, such as glycogen, partially deacetylated chitin and the like, marine plant gums such as algins, carageenans, laminarins and agar; microbial gums, such as dextrans, phosphomannans, etc. and proteins such as egg albumin, gluten, zein, etc. Starches such as starch ethers, starch esters, amylose, amylose pectin, and the like also may be employed. In addition, synthetic polymers, such as polyvinyl alcohol, polyvinyl acetate, polyoxyethylene, styrene-butadiene copolymers, etc., may be employed.

Preferred binders which are particularly useful in the tobacco substitutes of the present invention include the substituted cellulosic gums, such as cellulose ethers, cellulose esters and mixtures thereof. Specific examples of such binders include methyl cellulose, ethyl cellulose, hydroxypropyl cellulose, methylhydroxyethyl cellulose, sodium carboxymethyl cellulose, etc.

Particularly preferred binders are methyl cellulose such as that sold commercially under the designation "METHOCEL" (Dow Chemical Co.). As a specific example, mixtures of METHOCEL 1500 cp and METHOCEL 15 cp can be used. Another particularly preferred binder is a mixture of methyl cellulose and hydroxyethyl cellulose.

A mixture of methyl cellulose and cellulose acetate is also particularly preferred since inclusion of cellulose acetate, along with methyl cellulose, in the binder results in an improvement in wet strength or water-proofing properties of the tobacco substitute sheet. The increase in wet tensile strength occurs with as little as 6% cellulose acetate (1 part cellulose acetate to 15 parts methyl cellulose) in the binder, and is observed up through a complete replacement of the methyl cellulose with cellulose acetate.

Another particularly preferred binder is sodium carboxymethylcellulose. Unlike methyl cellulose, sodium carboxymethylcellulose is water soluble and thus sheets of tobacco substitutes using carboxymethylcellulose as a binder can be cast from water base, rather than solvent base, systems. When sodium carboxymethylcellulose is used as a binder, preferably a cross-linker, such as glyoxal, is included in the system to impart water resistance to the substitute.

While the binder may be employed in amounts of from about 5% to about 35% by weight, and preferably from about 10% to about 25% by weight, it should be recognized that the amount employed in any specific formulation will depend on several factors. The amount of binder employed will depend not only on the amount of other ingredients included, but also upon the specific nature of the other ingredients and the specific nature of the particular binder selected.

A small amount of a plasticizer or humectant is advantageously incorporated into the tobacco substitute sheets to improve flexibility. The specific plasticizer employed depends, of course, on the specific binder employed. Preferred plasticizers include polyhydric alcohols, for example, glycols such as glycerin, di- or triethylene glycol, or propylene glycol. The amount of plasticizer included depends, of course, in the particular binder system employed. Normally amounts up to about 7.5% bt weight are suitable.

To enhance the appearance of the tobacco substitutes, a coloring agent may be incorporated therein. While the tobacco substitutes could be made most any color, preferably coloring agents are added which will impart a color similar to that of natural tobacco. Among the suitable coloring agents are those certified by the Food and Drug Administration. Exemplary of the coloring agents which may be employed are FD&C Yellow No. 5, ferric oxide, charcoal, and mixtures thereof. Normally, synthetic coloring agents would be included in amounts of less than 1%.

As previously noted, tobacco fines impart a desirable brown color to the substitute. If desired, color also can be obtained by adding additional tobacco materials, such as the solids recovered from water extracted flue-cured stem. Such natural coloring agents could be included in amounts up to 10% by weight.

Flavoring agents also may be incorporated into the tobacco substitute. Various natural botanical extracts, including tobacco extracts, may be employed to color and flavor the substitutes. Other flavoring agents which may be used include those typically used commercially to flavor tobacco, such as menthol, tonka bean, vanillin, etc. Suitable synthetic coloring agents include imitation tobacco flavor (Firminich No. 52,644), dark fire cured resinoid flavor (IFF G02662), etc. Typically, less than 1% by weight of such flavoring agents would be included.

As previously noted, the tobacco substitutes of the present invention may optionally include monoammonium phosphate, diammonium phosphate or mixtures thereof. The phosphates appear to enhance somewhat the ash fusing properties of the inorganic filler and boron component of the tobacco substitutes. In addition, the phosphates are effective to improve smoke taste. The phosphates may be included in amounts up to about 15% by weight, and preferably in amounts up to about 10% by weight, e.g., about 3% to about 10%.

It is believed that the inclusion of the phosphates results in the delivery of a small quantity of ammonia to the smoke. The ammonia at least partially overcomes the taste of some burning binders, in particular, cellulose base binders. Diammonium phosphate is slightly superior to monoammonium phosphate in masking the burning binder taste, and is thus slightly preferred by smokers.

To impart strength and flex to the tobacco substitutes, it is often advantageous to include minor amounts (up to about 10% by weight, and preferably less than 5% by weight) of cellulosic fibers. Paper fibers are preferred, such as those obtained by grinding papers made from flax, bagasse, esparto, straw, cotton, papyrus, bamboo, jute, hard woods or soft woods.

The tobacco substitutes of the present invention may be prepared by mixing a binder with a solvent for the binder. If desired, a plasticizer for the binder may be included in the mixture. The amount of solvent and plasticizer used, of course, depends on the particular binder employed. Typically, for each part by weight of binder, at least 20 parts by weight of solvent are used, and the plasticizer is used in amounts of about 20% of the binder weight. The solvent mixture is agitated until a smooth, viscous, clear "dope" forms.

An inorganic filler such as alumina trihydrate and/or monoammonium or diammonium phosphate, the tobacco fines boric oxide, a boron oxyacid, or a salt of a boron oxyacid and, in some instances, a burn additive such as sodium nitrate, are added to the dope. The mixture is then stirred until all solids are suspended. Alternatively, the additives may be added to the dope and the mixture ball milled to insure good distribution of the solids through the binder.

The mixture is cast on a stainless steel surface and the solvent is evaporated. The resultant sheet is a smooth, thin, flexible film. The film may be added to tobacco and processed normally to produce smoking articles.

The specific solvent system employed depends upon the specific binder employed. Water or various organic solvents may be used. Particularly good results have been obtained using a binder of methyl cellulose or a mixture of methyl cellulose and a cellulose acetate with a solvent comprising 4 parts by volume methylene chloride and one part by volume methanol.

Very satisfactory results with methyl cellulose binders also have been obtained using various 20% alcohol-80% water mixtures. Water-methanol, water-ethanol, and water-isopropanol systems all produce acceptable sheets. Water-n-butanol and water-n-propanol solvent systems have not resulted in a coherent sheet. Satisfactory sheets have been obtained using methyl cellulose and a water solvent containing a small amount, e.g., about 5% by weight, of a wetting agent, such as hexadecanol. Satisfactory sheets have also been obtained using a mixture of methyl cellulose and hydroxyethylcellulose in a water solvent containing a small amount, e.g., about 5% by weight, of a cross-linking agent, such as glyoxal.

The water-alcohol mixtures result in sheets which have a very soft, flexible feel. In addition, the water-alcohol mixtures produce sheets having improved wet strength over sheets in which water alone was used as a solvent.

The present invention will be further illustrated by the specific examples which follow. These examples are intended to illustrate preferred embodiments and are in no way limiting.

EXAMPLE 1

94 grams of methyl cellulose (1500 cp) were mixed in a solvent comprising 3800 ml of a methylene chloride and 950 ml of methanol. To this mixture were added 28 grams of glycerine, 47 grams of cellulose acetate (waste filter tow), 47 grams of diammonium phosphate, 47 grams of sodium nitrate, and 47 grams of sodium borate decahydrate. The resulting mixture was placed in a ball mill and milled for 1 hour. Subsequently, 486 grams of alumina trihydrate and 175 grams of manufacturing fines were added and ball milling was continued for an additional half hour.

The resulting milled mixture was cast on a Keegam paper coating machine, fitted with a continuous Mylar belt as the casting surface for the tobacco substitute composition. The solvent was evaporated, using a blower and heaters to accelerate removal. The resultant sheet was a smooth, thin film which was very flexible.

The sheet was shredded, blended, in an amount of about 25% by weight, with cigarette tobacco, and formed into cigarettes. The resultant cigarettes, upon smoking, generated a normal-appearing ash and a pleasant, natural tasting smoke.

EXAMPLE 2

Using a Cowles high shear mixer, 20 grams of hydroxyethylcellulose (Union Carbide Cellosize WP-09) and 160 grams of methylcellulose (Dow 25 cp) were dissolved in 2300 ml of water containing 30 ml of glycerin and 1.5 ml of a propylene glycol defoamer (Dow P-1200). 540 grams of Reynolds RH-31F alumina trihydrate and 180 grams of manufacturing fines were dispersed in the mixture and 50 ml of a glyoxal (40% aq.) solution were added. The slurry was aged overnight and 30 grams of sodium nitrate, 40 grams of sodium borate decahydrate, and 30 grams of diammonium phosphate were added.

The slurry was cast on a stainless steel band and dried using overhead dryers. After conditioning, the resulting sheet was shredded; yielding approximately 25 pounds of material at 15% by weight moisture.

The shredded material was mixed with tobacco in a ratio of 25 parts by weight substitute to 75 parts by weight tobacco, and the tobacco substitute-tobacco mixture was made into cigarettes. Upon smoking, the substitute in these cigarettes produced a firm, coherent ash and a mild, pleasant smoke taste.

EXAMPLE 3

10 grams of methyl cellulose (1500 cp) were mixed in a solvent comprising 100 ml of methanol and 400 ml of methylene chloride. To this mixture were added 3 ml of glycerine, 5 grams of cellulose acetate, 5 grams of diammonium phosphate, 5 grams of sodium nitrate, 5 grams of sodium borate decahydrate, 51.5 grams of alumina trihydrate, and 18.5 grams of manufacturing fines. The resulting mixture was ball milled for four hours and hand cast on a stainless steel plate.

The resulting sheet was dried, moisture conditioned, shredded and blended with cigarette tobacco at a level of 25 parts by weight of the tobacco substitute to 75 parts by weight of the cigarette tobacco. The resulting blend was formed into cigarettes which, upon smoking, generated a firm, coherent, normal-appearing ash.

EXAMPLE 4

The procedure of Example 3 was repeated, except that the manufacturing fines and sodium nitrate were replaced with an additional 23.5 grams of alumina trihydrate. Upon smoking, cigarettes containing the tobacco substitute of this Example generated an unacceptably expanded ash.

EXAMPLE 5

A solvent cast tobacco substitute material was prepared having the following formulation:

| | |
|---|---|
| Methyl Cellulose (1500 cp - Dow) | 113 g |
| Methyl Cellulose (15 cp - Dow) | 113 g |
| Cellulose Acetate | 113 g |
| Sodium Borate Decahydrate | 113 g |
| Sodium Citrate | 113 g |
| Diammonium Phosphate (450 ml of a 22.9% aqueous solution) | 113 g |
| Paper Fiber | 44 g |
| Manufacturing Fines | 368 g |
| Alumina Trihydrate | 1123 g |
| Dark Fire Cured Flavor (IFF, G02662) | 11.56 ml |
| Imitation Tobacco Flavor (Firminich, 52,644) | 2.25 ml |
| Carbon Black | 5.4 g |
| FD&C Yellow #5 | 5.4 g |
| Ferric Oxide | 2.2 g |
| Glycerin | 90 g |

The paper fiber was soaked in water and stirred with an air-powered mixer to open and separate fiber bundles. After stirring, the water was decanted and the fibers rinsed with methanol.

A slurry of the various ingredients was prepared with a Cowles high shear mixer using 5.78 l of a 4:1 by volume methylene chloride-methanol solvent. The slurry was cast on a stainless steel band (target thickness in the range of 0.006 to 0.008 inch), and dried without the application of heat.

As the material was doctored off the band, it was sliced and diced into nominal 3-inch squares. When all batches had been cast, the material was exposed to 75° F., 60% RH atmosphere for 16 hours for moisture conditioning.

The substitute was included in several commercial cigarette tobacco blends in amounts of 20% by weight and formed into cigarettes. In blind tests against control cigarettes containing only the commercial tobacco blends, smokers did not show any significant preference for the control.

The substitute containing cigarettes did not bloom unacceptably. The substitute containing cigarettes exhibited an average bloom factor of 1.39, compared to a bloom factor of 1.23 for the control.

EXAMPLE 6

A water-cast tobacco substitute was prepared having the following formulation:

| | |
|---|---|
| Water | 8 gal |
| Extract from flue-cured stem | 12 gal |
| Paper Fiber | 2.97 lb |
| Sodium CMC (Hercules Grade 7LF) | 8.59 lb |
| Glycerin | 900 ml |
| Defoamer (Dow P-1200) | 45 ml |
| Alumina Trihydrate | 35.68 lb |
| Manufacturing Tobacco Fines | 8.92 lb |
| Glyoxal (40% aq.) | 1500 ml |
| Sodium Citrate | 3.30 lb |
| Sodium Borate Decahydrate | 3.30 lb |

The paper fiber (strips cut from a compressed sheet of fibers) was added to sufficient water for dispersion with a Cowles high shear mixer. Additional water, flue-cured stem liquor, and the dispersed fiber were added to a Groen mixer and heated to 140°-150° F. Sodium CMC was added and dissolved followed by addition of glycerin and defoamer. Alumina and manufacturing fines were added, and after further agitation (ca. 1 hour), the mixture was allowed to cool overnight. Sodium citrate and borax were added and the slurry was cast on a stainless steel band moving at slow speed. Overhead dryers were used to dry the sheet.

The sheet was sliced and cut into approximate 3-inch squares as it was doctored from the band. The material was conditioned at 75° F., 60% RH for 16 hours prior to blending and cigarette making.

The substitute was incuded in several commercial cigarette tobacco blends in amounts of 20% by weight and formed into cigarettes. In blind tests against control cigarettes containing only the commercial tobacco blends, smokers did not show any significant preference for the control.

The substitute containing cigarettes did not bloom unacceptably. They exhibited an average bloom factor of 1.25 compared to 1.23 for the control.

EXAMPLE 7

Following the procedure of Example 5, a solvent cast tobacco substitute sheet was prepared comprising:

| | % by weight |
|---|---|
| Methyl cellulose (1500 cp) | 4.7 |
| Methyl cellulose (15 cp) | 4.7 |
| Alumina trihydrate | 47.9 |

-continued

| | % by weight |
|---|---|
| Manufacturing fines | 15.3 |
| Sodium citrate | 4.7 |
| Cellulose acetate | 4.7 |
| Sodium borate | 4.7 |
| Paper fiber | 1.9 |
| Diammonium phosphate | 4.7 |
| Dark fire-cured resinoid flavor (IFF, G02662) | 0.4 |
| Imitation tobacco flavor (Firminich, 52,644) | 0.10 |
| Glycerol | 5.6 |
| FD&C Yellow #5 | 0.25 |
| Ferric oxide | 0.10 |
| Charcoal | 0.25 |

The resulting sheet was shredded and blended, in an amount of about 25% by weight, with cigarette tobacco, and formed into cigarettes. The resultant cigarettes, upon smoking, generated a normal-appearing, coherent ash and a pleasant natural tasting smoke.

EXAMPLE 8

Following the procedure of Example 2, a water cast tobacco substitute sheet was prepared comprising:

| | % by weight |
|---|---|
| Sodium carboxymethylcellulose | 12.3 |
| glyoxal | 1.9 |
| Alumina trihydrate | 50.9 |
| Manufacturing fines | 12.7 |
| Sodium citrate | 4.7 |
| Sodium borate | 4.7 |
| Paper fiber | 4.2 |
| Glycerol | 2.8 |
| Flue-cured stem extract solids | 5.7 |

Upon shredding, blending with cigarette tobacco (25% by weight substitute), forming into cigarettes, and smoking, a firm, coherent ash and a mild, pleasant smoke was produced.

Those skilled in the art will visualize many modifications and variations of the invention set forth above without departing from its spirit and scope. Accordingly, while the preferred embodiments of the invention have been described, it is understood that the invention is not confined to specifics set forth by way of illustration.

What is claimed is:

1. A tobacco substitute, which comprises:

(a) from about 10% to about 40% by weight of tobacco fines, the presence of said tobacco fines reducing ash blooming when said substitute is combusted;

(b) from about 5% to about 35% by weight of an organic binder;

(c) from about 2% to about 35% by weight of an ash stabilizing filler which is a boron compound selected from the group consisting of boric oxide, a boron oxyacid, and ammonium, alkali metal, and alkaline earth metal salts of a boron oxyacid and mixtures thereof; and (d) from about 25% to about 75% by weight of an inorganic filler selected from the group consisting of alumina, alumina trihydrate, magnesium carbonate, calcium carbonate, charcoal and mixtures thereof.

2. The tobacco substitute of claim 1, wherein said tobacco fines are selected from the group consisting of manufacturing fines, ground burley stem, ground flue-cured stem, and mixtures thereof.

3. The tobacco substitute of claim 2 which includes about 10% to about 25% tobacco fines.

4. The tobacco substitute of claim 1 which includes about 40% to about 60% by weight of said inorganic filler.

5. The tobacco substitute of claim 1 which additionally includes up to about 15% by weight of a material selected from the group consisting of monoammonium phosphate, diammonium phosphate, and mixtures thereof.

6. The tobacco substitute of claim 5 which additionally includes up to about 10% by weight cellulosic fibers.

7. The tobacco substitute of claim 6 in which said cellulosic fibers are paper fibers.

8. The tobacco substitute of claim 1 which additionally includes up to about 10% by weight of a burn additive selected from the group consisting of sodium nitrate, sodium citrate, potassium tartrate and mixtures thereof.

9. The tobacco substitute of claim 1 in which said boron compound is borax.

10. The tobacco substitute of claim 1 in which said inorganic filler is alumina trihydrate.

11. The tobacco substitute of claim 1 which includes about 10% to about 25% binder.

12. The tobacco substitute of claim 1 which includes about 3% by weight to about 10% by weight of said boron compound.

13. The tobacco substitue of claim 1 in which said inorganic filler is alumina trihydrate.

14. The tobacco substitue of claim 1 in which said binder is selected from the group consisting of methyl cellulose, cellulose acetate, hydroxyethyl cellulose, sodium carboxymethyl cellulose, and mixtures thereof.

15. The tobacco substitute of claim 14 in which said binder consists of a mixture of methyl cellulose and cellulose acetate.

16. The tobacco substitute of claim 14 in which said binder is sodium carboxymethyl cellulose.

17. A smoke article comprising tobacco blended with up to about 50% of the tobacco substitute of claim 1.

18. A tobacco substitute comprising:

(a) from about 10% to about 40% by weight of tobacco fines selected from the group consisting of manufacturing fines, ground flue-cured stem, ground burley stem, and mixtures thereof, the presence of said tobacco fines reducing ash blooming when said substitute is combusted;

(b) from about 25% to about 75% by weight of an inorganic filler selected from the group consisting of alumina, alumina trihydrate, calcium carbonate, magnesium carbonate, charcoal and mixtures thereof;

(c) from about 2% to about 35% by weight of an ash stabilizing filler which is a boron compound selected from the group consisting of boric oxide, a boron oxyacid, and ammonium, alkali metal, and alkaline earth metal salts of a boron oxyacid and mixtures thereof;

(d) up to about 15% by weight of a phosphate material selected from the group consisting of monoammonium phosphate, diammonium phosphate and mixtures thereof;

(e) from about 5% to about 35% by weight of an organic binder;

(f) up to about 10% by weight of a burn additive selected from the group consisting of sodium nitrate, sodium citrate, potassium tartrate, and mixtures thereof; and (g) up to about 10% by weight cellulosic fibers.

19. The tobacco substitute of claim 18 in which said tobacco fines are manufacturing fines.

20. The tobacco substitute of claim 18 in which said boron compound is borax.

21. The tobacco substitute of claim 18 in which said binder is selected from the group consisting of methyl cellulose, cellulose acetate, hydroxyethyl cellulose, sodium carboxymethyl cellulose and mixtures thereof.

22. A smoke article comprising tobacco blended with up to about 50% of the tobacco substitute of claim 18.

23. The tobacco substitute of claim 18 in which said inorganic filler is alumina trihydrate.

24. The tobacco substitute of claim 18 which comprises from about 10% to about 25% by weight of said tobacco fines; from about 40% to about 60% by weight of said inorganic filler; from about 3% to about 10% by weight of said boron compound; up to about 10% by weight of said phosphate material; and up to about 5% by weight paper fibers.

25. The tobacco substitute of claim 24 in which said tobacco fines are manufacturing fines; said inorganic filler is alumina trihydrate; said boron compound is borax; said phosphate material is diammonium phosphate; and said burn additive is sodium citrate.

26. The tobacco substitute of claim 25 in which said binder is sodium carboxymethylcellulose.

27. A smoke article comprising tobacco blended with up to about 50% of the tobacco substitute of claim 26.

28. The tobacco substitute of claim 25 in which said binder is cellulose acetate and methyl cellulose.

29. A smoke article comprising tobacco blended with up to about 50% of the tobacco substitute of claim 28.

30. The tobacco substitute of claim 1 wherein the proportion of tobacco fines is an excess of about 20%.

31. The tobacco substitute of claim 18 wherein the proportion of tobacco fines is less than 20%.

* * * * *